United States Patent [19]

Roach

[11] 4,232,863

[45] Nov. 11, 1980

[54] FITNESS BAR

[75] Inventor: Herschel Roach, Clarksville, Tex.

[73] Assignee: O & R Products, Incorporated, Clarksville, Tex.

[21] Appl. No.: 907,484

[22] Filed: May 19, 1978

[51] Int. Cl.[3] ..... A63B 1/00

[52] U.S. Cl. ..... 272/111

[58] Field of Search ..... 272/62, 63, 70, 93, 272/109, 111, 117, 144

[56] References Cited

U.S. PATENT DOCUMENTS

| | | | |
|---|---|---|---|
| 1,570,307 | 1/1926 | Kirby | 272/63 |
| 2,666,640 | 1/1954 | Jennings | 272/63 |
| 2,900,008 | 8/1959 | Seger | 272/93 X |
| 2,919,918 | 1/1960 | Horn | 272/111 |
| 3,077,347 | 2/1963 | Nova | 272/111 |
| 3,114,545 | 12/1963 | Horn | 272/111 |
| 3,173,415 | 3/1965 | Rubin | 272/109 X |
| 3,430,954 | 3/1969 | Massey | 272/62 |
| 3,540,724 | 11/1970 | Hunter | 272/63 |
| 3,572,701 | 3/1971 | Agamian | 272/117 X |
| 3,591,173 | 7/1971 | Cossman | 272/111 |
| 3,679,203 | 7/1972 | Grana | 272/111 |
| 3,688,789 | 9/1972 | Bunch | 272/70 X |
| 3,879,033 | 4/1975 | Martin | 272/111 |
| 3,915,452 | 10/1975 | Winblad | 272/62 |
| 3,920,240 | 11/1975 | Ross | 272/63 X |
| 3,944,219 | 3/1976 | LoPresti | 272/62 |

FOREIGN PATENT DOCUMENTS

| | | | |
|---|---|---|---|
| 904366 | 7/1972 | Canada | 272/93 |
| 2136605 | 2/1973 | Fed. Rep. of Germany | 272/62 |
| 771089 | 9/1934 | France | 272/63 |
| 2286665 | 4/1976 | France | 272/109 |
| 1161855 | 8/1969 | United Kingdom | 272/62 |

*Primary Examiner*—Richard J. Apley

*Attorney, Agent, or Firm*—Richards, Harris & Medlock

[57] ABSTRACT

A fitness bar for supporting a person during the performance of physical exercise includes a base bar that is normally disposed along a horizontal surface to support one end of the fitness bar. A pair of support arms extend generally upwardly from the distal ends of the base bar, and a pair of transverse beam bars extend laterally from the upper ends of the support arms. A pair of support legs extend downwardly from the ends of the transverse beam bars for engaging the horizontal surface to support the other end of the fitness bar. The transverse beam bars are spaced apart a sufficient distance to allow a person to perform physical exercise by grasping said beam bars and moving through strenuous positions between the beam bars.

8 Claims, 12 Drawing Figures

FITNESS BAR

FIELD OF THE INVENTION

The present invention relates to exercise devices, and more particularly to a fitness bar for supporting the weight of a person during physical exercise.

BACKGROUND AND SUMMARY OF THE INVENTION

A large number of exercise devices have been used to facilitate physical exercise. Many of such devices ae designed to allow a person to exercise by lifting his own weight. Pullup bars, parallel beams, suspended rings, climbing ropes, etc., are all designed to support the weight of a person during physical exercise.

Many such exercise devices require complementary support structures available only in a gymnasium. As man's work has become less physically demanding, the need for less costly and more generally available exercise devices has grown. For the convenience of the user, a need has arisen for a simple exercise device that may be used in the home. Such device needs to be generally portable and relatively small so that it may be easily stored after use. Furthermore, a need has arisen for an exercise device that may be used by anyone.

The fitness bar of the present invention has fulfilled these needs by providing a compact device that is portable and may be used practically anywhere and that is easily stored. The user of the fitness bar exercises against his own weight, and the fitness bar, itself, is relatively lightweight. Also, the fitness bar is designed for use by men, women, and youth of all ages; is relatively inexpensive; and may be used to exercise many different parts of the body.

In accordance with the present invention, a fitness bar is provided for supporting a person during the performance of physical exercise. The fitness bar includes a base bar that is normally disposed along the floor to support one end of the fitness bar. A pair of support arms extend generally upwardly from the distal ends of the base bar, and a pair of transverse beam bars extend laterally from the upper ends of the support arms. A pair of support legs extend downwardly from the ends of the transverse beam bars for engaging the floor to support the other end of the fitness bar. The transverse beam bars are spaced apart a sufficient distance to allow a person to fit between the transverse beam bars. Thus, a person may perform physical exercise by grasping the beam bars and moving through strenuous positions between the beam bars.

In accordance with a more particular aspect of the present invention, the fitness bar may be constructed of one continuous tubular bar such as a chrome plated steel tube. The base bar is approximately 8 inches in length, and normally rests on a horizontal surface. The support arms are approximately 11 and ½ inches long, extending outwardly from the base bar at an angle of approximately 55° with respect to horizontal such that the upper end of the support arms is positioned at a vertical height of approximately 9 inches and is spaced outwardly from the end of the base bar at a horizontal distance of approximately 7 inches. The transverse beam bars are approximately 11 inches long and extend laterally from the upper end of the support arms at an angle of approximately 20° with respect to horizontal. The support legs are approximately 13 inches in length and extend downwardly at an angle of approximately 5° with respect to vertical for engaging the horizontal surface to support the other end of the fitness bar. In this construction, the transverse beam bars are spaced apart approximately 22 inches such that most people will fit between the beam bars. A pair of rubber cups may be fitted on the lower ends of the support legs to prevent scuffing of the horizontal surface during the use of the fitness bar. Also, a pair of grips may be provided covering at least a portion of the transverse beam bars to enhance the user's grasp thereon.

BRIEF DESCRIPTION OF THE DRAWINGS

The advantages and further aspects of the present invention will be readily appreciated by those of ordinary skill in the art as the same becomes better understood by reference to the following Detailed Description when considered in conjuction with the accompanying Drawings in which.

DETAILED DESCRIPTION OF THE DRAWINGS

Figure 1:
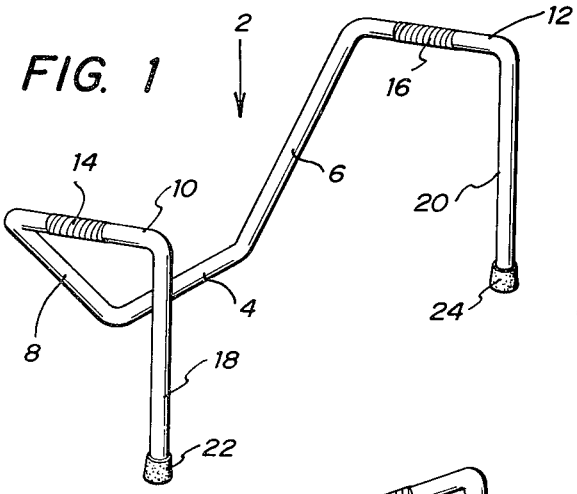
FIG. 1 is a perspective view of a fitness bar embodying the present invention.

Referring now to the drawings in which like reference characters are used for like or similar parts throughout the several views, there is shown in FIG. 1 a perspective view of a fitness bar 2 embodying the present invention. Fitness bar 2 includes a base bar 4 that is normally disposed along a horizontal surface for supporting one end of the fitness bar. A pair of support arms 6 and 8 extend in a generally upward direction from the two distal ends of the base bar 4, and a pair of transverse beams bars 10 and 12 extend laterally from the upper ends of the support arms 6 and 8. As an option, a pair of grips 14 and 16 may be provided covering at least a portion of transverse beam bars 10 and 12 for providing a firm grip or enhancing the grasp of the user thereon. A pair of support legs 18 and 20 extend in a downward direction from the ends of the transverse beam bars 10 and 12 to engage a horizontal surface and support the other end of the fitness bar 2. To prevent scuffing of a horizontal surface such as a floor during the use of the fitness bar 2, a pair of rubber cups 22 and 24 may be used to cap the lower ends of the support legs 18 and 20.

Figure 2:
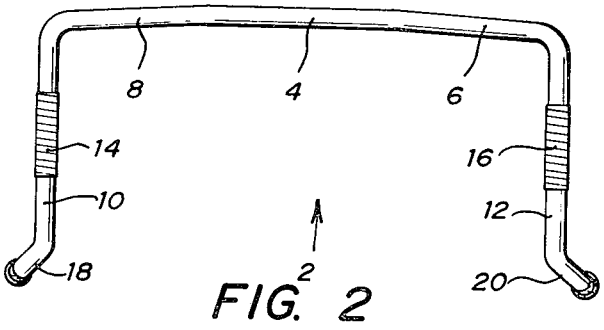
FIG. 2 is a top view of the fitness bar.

Referring now to FIG. 2, a top view of the fitness bar 2 is shown. The base bar 4 is approximately 8 inches long, and the support arms 6 and 8 extend in an upward and outward direction from the distal ends of base bar 4. The upper ends of arms 6 and 8 are positioned outwardly from the base bar 4 spaced apart at a distance of approximately 22 inches. In this view, it may also be seen that arms 6 and 8 are bent slightly in the direction of the support legs 18 and 20 at an angle of approximately 2° with respect to the base bar 4.

The transverse beam bars 10 and 12 extend laterally from the support arms 6 and 8 for a horizontal distance of approximately 10 inches. The support legs 18 and 20 extend downwardly from the ends of beam bars 10 and 12 at a slight outward angle of approximately 5° with respect to vertical.

Figure 3:
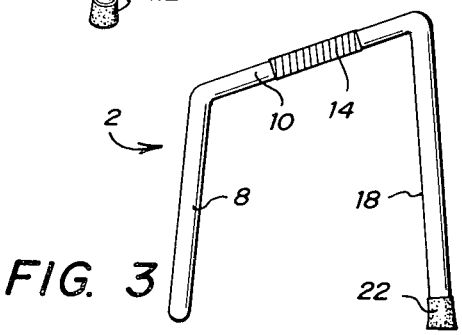
FIG. 3 is a side elevational view of the fitness bar.

Referring now to FIG. 3 a side elevational view of fitness bar 2 is shown. In this view, it may be seen that the support arm 8 leans towards support leg 18 at an angle of approximately 2° and that support leg 18 leans towards arm 8 at an angle of approximately 3°. The inclination angles of arm 8 and support leg 18 provide additional stability for the fitness bar 2. Transverse beam bar 10 is approximately 11 inches in length and extends between arm 8 and leg 18 at an angle of approximately 20°. The inclination angle of transverse beam 10 allows the user to grasp the fitness bar 2 at different heights above the horizontal surface on which it is supported.

Figure 4:
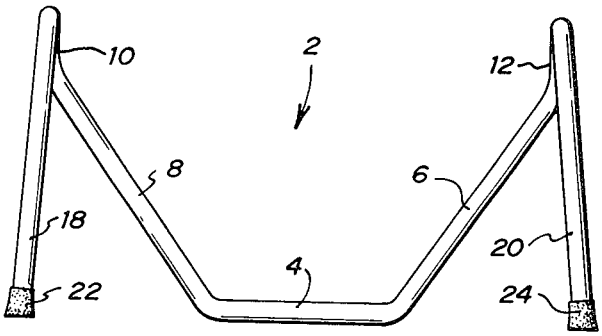
FIG. 4 is a front elevational view of the fitness bar.

Referring now to FIG. 4, a front elevational view of the fitness bar 2 is shown. In this view, it may be appreciated that the support arms 6 and 8 are approximately 11 and ½ inches in length and extend upwardly and outwardly from the base bar 4 at an angle of approximately 55° with respect to a horizontal plane or surface which is defined by the lower ends of the support legs 18 and 20 and the base bar 4. Also, it may be appreciated that the support legs 18 and 20 are approximately 13 inches long and extend downwardly and outwardly at an angle of approximately 5° with respect to vertical. The inclination of legs 18 and 20 provides additional stability for the fitness bar.

Referring now to FIGS. 2 and 4, it may be appreciated that the transverse beam bars 10 and 12 are spaced apart at approximately 22 inches such that a user performing exercise with the fitness bar 2 can fit between the transverse beam bars 10 and 12. One end of the fitness bar 2 is supported by the base bar 4, while the other end of the fitness bar is supported by the support legs 18 and 20. In this configuration, one end of the fitness bar is completely open and the other end of the fitness bar is substantially unobstructed. Thus, a user of the fitness bar may suspend himself at least partially between the transverse beam bars during the performance of various exercises.

Figure 5:
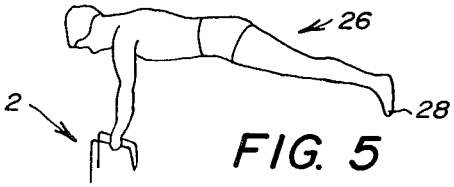
FIG. 5 illustrates the use of the fitness bar for performing pushups.

Referring now to FIG. 5, there is shown a man 26 performing a pushup using the fitness bar 2. While grasping the fitness bar 2, the man 26 raises and lowers his body about a pivot point defined by his toes 28. This exercise develops arms and upper body. Using the fitness bar, the man 26 may lower himself until his hands are approximately level with his shoulders, thereby, placing himself in a more strenuous position than is normally encountered in the performance of a standard pushup.

Figure 6:
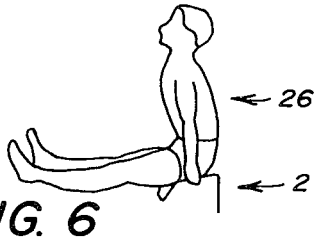
FIG. 6 illustrates a straight leg lift exercise.

Referring now to FIG. 6, there is shown a man 26 performing a straight leg lifts in which the legs are held in a horizontal position while the man 26 raises and lowers himself using the fitness bar 2. This exercise develops abdominal regions, shoulder, hips and legs.

Figure 7:
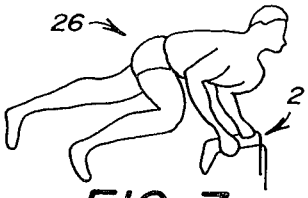
FIG. 7 illustrates a running in place exercise.

Referring now to FIG. 7, there is shown a man 26 performing a running in place exercise using the fitness bar 2. This exercise is performed by grasping the fitness bar 2 and alternately moving each leg forwards and backwards to simulate running in a squat position.

Figure 8:
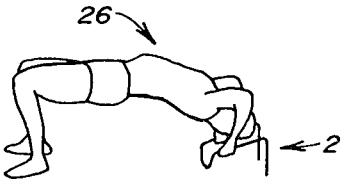
FIG. 8 illustrates a neck bridge exercise.

Referring now to FIG. 8, there is shown a man 26 performing a neck bridge exercise. While bowing his back and partially supporting himself by grasping the fitness bar 2, the man 26 will place his head on a pad such as a folded towel and will lean his body forwards and backwards to exercise and develop his neck.

Figure 9:
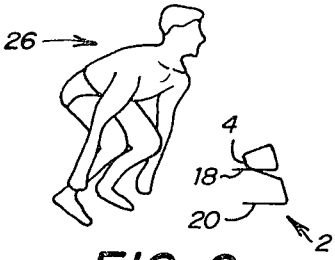
FIG. 9 illustrates the use of the fitness bar as a jumping bar.

Referring now to FIG. 9, there is shown a man 26 using the fitness bar as a jumping bar. To perform this exercise, the fitness bar is reoriented to place the support legs 18 and 20 along a horizontal support surface. In this position, the base bar 4 is elevated above the floor and may be used as a jumping bar. The man 26 simply jumps back and forth over the fitness bar 2.

Figure 10A:
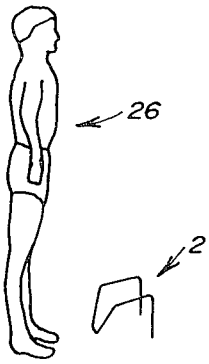
FIGS. 10*a*, 10*b* and 10*c* illustrate a squat thrust exercise.
Figure 10B:
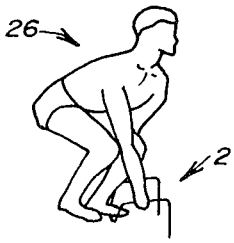
Figure 10C:
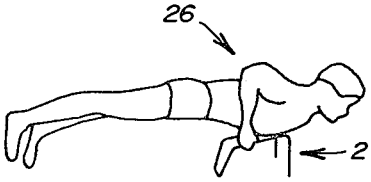

Referring now to FIGS. 10*a*, 10*b*, and 10*c* there is shown a man 26 performing a squat thrust exercise. To perform this exercise, the man 26 begins in a standing start position as shown in FIG. 10*a*. Then, the man 26 moves to a squatting position and grasps the fitness bar 2 as shown in FIG. 10*b*. Next, the man 26 thrusts his legs outwardly while supporting himself on the fitness bar 2. These steps are then reversed until the man 26 again assumes the standing start position as shown in FIG. 10*a*.

Although a particular embodiment of the present invention has been described in the foregoing detailed description, it will be understood that the invention is capable of numerous modifications without departing from the spirit of the invention.

What is claimed:

1. A fitness bar for supporting a person during performance of physical exercise, comprising:

a pair of transverse spaced apart beam bars;

a pair of support legs extending downwardly from the beam bars for engaging a supporting surface to support one end of the fitness bar, said support legs being spaced apart a distance substantially the same distance as said beam bars;

a base bar for being disposed along the supporting surface between said beam bars and support legs to support the other end of the fitness bar;

a pair of support arms extending upwardly and outwardly at an angle from the distal ends of said base bar between said beam bars and support legs, said beam bars extending laterally from the upper ends of said support arms; and said transverse beam bars being spaced apart a distance to allow a person to perform physical exercise by grasping said beam bars and moving through strenuous positions between said beam bars.

2. The fitness bar as set forth in claim 1 wherein the base bar, the support arms, the beam bars, and the support legs are constructed of one continuous tubular bar.

3. The fitness bar as set forth in claim 1 wherein the beam bars are inclined at about 20° with respect to the horizontal surface.

4. The fitness bar as set forth in claim 1 wherein said support legs extend downwardly and outwardly at an angle of about 5° with respect to vertical where the horizontal surface defines the horizontal plane.

5. The fitness bar as set forth in claim 1 wherein rubber cups are provided on the ends of said legs that engage the horizontal surface.

6. The fitness bar as set forth in claim 1 wherein said fitness bar is constructed from one continuous chrome plated steel tube.

7. The fitness bar as set forth in claim 1 further comprising a pair of grips covering at least a portion of said beam bar to enhance the ability of a person to grasp the beam bar.

8. A fitness bar constructed of a continuous, chrome plated tube and for supporting a person during the performance of physical exercise, comprising:

a base bar of approximately 8 inches in length for being disposed along a horizontal surface to support one end of the fitness bar;

a pair of support arms of approximately 11 and ½ inches in length extending outwardly from the distal ends of said base bar and upwardly at an angle of approximately 55° with the horizontal surface;

a pair of transverse beam bars having a length of approximately 11 inches and extending laterally from the upper end of said support arms at an angle of approximately 20° with respect to horizontal;

a pair of support legs having a length of approximately 13 inches and extending downwardly from the beam bars at an angle of approximately 5° with respect to vertical for engaging the horizontal surface to support the other end of the fitness bar; and said transverse beam bars being spaced apart approximately 22 inches for allowing a person to perform physical exercise by grasping said beam bars and moving through strenuous positions between said beam bars.

* * * * *